US009669513B2

(12) United States Patent
Kobayashi

(10) Patent No.: US 9,669,513 B2
(45) Date of Patent: Jun. 6, 2017

(54) DOUBLE-DISC GRINDING APPARATUS AND WORKPIECE DOUBLE-DISC GRINDING METHOD

(71) Applicant: SHIN-ETSU HANDOTAI CO., LTD., Tokyo (JP)

(72) Inventor: Kenji Kobayashi, Nishigo-mura (JP)

(73) Assignee: SHIN-ETSU CHEMICAL CO., LTD., Tokyo (JP)

( * ) Notice: Subject to any disclaimer, the term of this patent is extended or adjusted under 35 U.S.C. 154(b) by 219 days.

(21) Appl. No.: 14/405,326

(22) PCT Filed: Jun. 3, 2013

(86) PCT No.: PCT/JP2013/003476

§ 371 (c)(1),
(2) Date: Dec. 3, 2014

(87) PCT Pub. No.: WO2014/006818

PCT Pub. Date: Jan. 9, 2014

(65) Prior Publication Data

US 2015/0147944 A1 May 28, 2015

(30) Foreign Application Priority Data

Jul. 3, 2012 (JP) ..... 2012-149203

(51) Int. Cl.
*B24B 41/06* (2012.01)
*B24B 7/17* (2006.01)
(Continued)

(52) U.S. Cl.
CPC ..... *B24B 41/067* (2013.01); *B24B 7/17* (2013.01); *B24B 7/228* (2013.01); *B24B 37/08* (2013.01); *B24B 37/28* (2013.01)

(58) Field of Classification Search
CPC ..... B24B 37/08; B24B 37/28; B24B 7/17; B24B 7/228; B24B 41/067
(Continued)

(56) References Cited

U.S. PATENT DOCUMENTS 3,560,064 A * 2/1971 Silver ..... F16C 32/0644 384/114
3,583,774 A * 6/1971 De Gast ..... B23Q 1/38 184/5
(Continued)

FOREIGN PATENT DOCUMENTS

CN 1652307 A 8/2005
CN 101417405 A 4/2009
(Continued)

OTHER PUBLICATIONS

Dec. 24, 2014 Office Action issued in Japanese Application No. 2012-149203.
(Continued)

*Primary Examiner* — Larry E Waggle, Jr.
*Assistant Examiner* — Henry Hong
(74) *Attorney, Agent, or Firm* — Oliff PLC

(57) ABSTRACT

The invention is directed to a double-disc grinding apparatus including: a rotatable ring holder configured to support a sheet workpiece along a circumferential direction from an outer circumference side of the workpiece; a pair of grinding wheels for grinding surfaces of the workpiece supported by the ring holder; and a hydrostatic bearing for supporting the ring holder without contact from both of a direction of a rotational axis of the ring holder and a direction perpendicular to the rotational axis by hydrostatic pressure of fluid supplied from both directions, wherein supply pressures at which the fluid is supplied from the direction of the rotational axis and from the direction perpendicular to the
(Continued)

rotational axis can be independently controlled. The invention provides a double-disc grinding apparatus and a workpiece double-disc grinding method that can improve variation in nanotopography depending on the lot of workpieces or grinding wheels to obtain nanotopography stably.

2 Claims, 6 Drawing Sheets

(51) Int. Cl.
*B24B 37/08* (2012.01)
*B24B 37/28* (2012.01)
*B24B 7/22* (2006.01)

(58) Field of Classification Search
USPC ..... 451/58
See application file for complete search history.

(56) References Cited

U.S. PATENT DOCUMENTS 4,643,592 A * 2/1987 Lewis ..... F16C 17/03 384/100
6,062,959 A * 5/2000 Weldon ..... B24B 21/10 257/E21.214
6,110,023 A * 8/2000 Shinomoto ..... B24B 7/17 451/262
6,149,503 A * 11/2000 Laycock ..... B24B 41/067 451/251
6,296,553 B1 10/2001 Nishi et al.
2005/0173377 A1* 8/2005 Pietsch ..... B24B 7/17 216/88
2009/0104846 A1 4/2009 Junge et al.
2011/0053470 A1* 3/2011 Kato ..... B24B 41/067 451/63

FOREIGN PATENT DOCUMENTS

CN 101939136 A 1/2011
JP A-6-304854 11/1994
JP A-10-291146 11/1998
JP A-2005-223344 8/2005
JP A-2009-190125 8/2009
JP A-2011-161611 8/2011
TW 201000260 A1 1/2010

OTHER PUBLICATIONS

International Search Report issued in PCT/JP2013/003476 mailed Jul. 9, 2013.
Dec. 10, 2015 Search Report issued in Chinese Patent Application No. 2013800352451.
May 23, 2016 Office Action issued in Taiwanese Patent Application No. 102121163.

* cited by examiner

DOUBLE-DISC GRINDING APPARATUS AND WORKPIECE DOUBLE-DISC GRINDING METHOD

TECHNICAL FIELD

The present invention relates to a double-disc grinding apparatus and a workpiece double-disc grinding method that simultaneously grind both surfaces of a sheet workpiece such as a semiconductor wafer or a quartz substrate for use as an exposure plate.

BACKGROUND ART

Advanced devices using a silicon wafers with a large diameter represented by, for example, a diameter of 300 mm are required to reduce surface waviness components, which are called nanotopography. Nanotopography is a kind of a surface shape of a wafer and exhibits irregularities of a wavelength component of 0.2 to 20 mm, which is shorter than the wavelength of a warpage or warp and longer than the wavelength of surface roughness. The nanotopography has an extremely shallow waviness component with a peak-to-valley value of 0.1 to 0.2 μm. It is said that the nanotopography affects yields of shallow trench isolation (STI) processes in device processes, and strict standards of nanotopography, together with the shrinking of design rules, are required of silicon wafers for use in device substrates.

Nanotopography is formed during processing of silicon wafers. The nanotopography is easy to degrade particularly in processing operations without a reference plane such as slicing with a wire saw or double-disc grinding. It is important to improve and manage relative meandering of a wire during slicing with a wire saw and wafer strain by double-disc grinding.

A conventional double-disc grinding method will now be described. FIG. 10 is a schematic diagram of an example of a conventional double-disc grinding apparatus.

As shown in FIG. 10, the double-disc grinding apparatus 101 includes a rotatable ring holder 102 configured to support a sheet workpiece W, a pair of hydrostatic supports 103 for supporting the ring holder 102 without contact by hydrostatic pressure of fluid, a pair of grinding wheels 104 for simultaneously grinding both surfaces of the workpiece W supported by the ring holder 102. The pair of hydrostatic supports 103 are located on the respective sides of the side faces of the ring holder 102. The grinding wheels 104 are attached to motors 112 and capable of rotating at a high speed.

With the double-disc grinding apparatus 101, the workpiece W is first supported along a circumferential direction from the outer circumference side of the workpiece by the ring holder 102. While the ring holder 102 is then rotated to rotate the workpiece W, fluid is supplied to spaces between the ring holder 102 and each of the hydrostatic supports 103 to support the ring holder 102 by the hydrostatic pressure of the fluid. In this way, both surfaces of the rotating workpiece W that is supported by the ring holder 102 and the hydrostatic supports 103 are ground with the grinding wheels 104 that are rotated at a high speed by the motors 112.

In conventional double-disc grinding, there are many factors that degrade nanotopography. As disclosed, for example, in Patent Document 1, it is known that a positional deviation of the ring holder along the direction of its rotational axis is one major factor. In view of this, it is known that a preferable supporting method to rotate a ring holder with high precision is to use a hydrostatic bearing for supporting the ring holder without contact by supplying fluid from both of the direction of the rotational axis of the ring holder and the direction perpendicular to the rotational axis (See Patent Document 2).

There is, however, a problem in that even when such a hydrostatic bearing is used, the nanotopography may degrade and thus highly precise nanotopography cannot be obtained stably.

CITATION LIST

Patent Literature

Patent Document 1: Japanese Unexamined Patent publication (Kokai) No. 2009-190125
Patent Document 2: Japanese Unexamined Patent publication (Kokai) No. 2011-161611

SUMMARY OF INVENTION

Technical Problem

The present inventor accordingly investigated the phenomenon of degrading nanotopography in detail and found that great variation in nanotopography occurs particularly after the lot of raw material workpieces is changed or grinding wheels are exchanged.

The present invention was accomplished in view of the above-described problems. It is an object of the present invention to provide a double-disc grinding apparatus and a workpiece double-disc grinding method that can improve variation in nanotopography caused depending on the lot of workpieces or grinding wheels to obtain highly precise nanotopography stably in every grinding process.

Solution to Problem

To achieve this object, the present invention provides a double-disc grinding apparatus comprising: a rotatable ring holder configured to support a sheet workpiece along a circumferential direction from an outer circumference side of the workpiece; a pair of grinding wheels for simultaneously grinding both surfaces of the workpiece supported by the ring holder; and a hydrostatic bearing for supporting the ring holder without contact from both of a direction of a rotational axis of the ring holder and a direction perpendicular to the rotational axis by hydrostatic pressure of fluid supplied from both the directions, wherein supply pressures at which the fluid is supplied from the direction of the rotational axis and from the direction perpendicular to the rotational axis can be independently controlled.

Such a double-disc grinding apparatus can independently control support rigidities of the ring holder in the direction of the rotational axis and the direction perpendicular to the rotational axis, enabling highly precise nanotopography to be obtained stably in every grinding process even when the workpiece lot is changed or the grinding wheels are exchanged.

In a preferable apparatus, the supply pressures at which the fluid is supplied can be controlled such that a degree of rigidity A is 200 gf/μm or less and a degree of rigidity B is 800 gf/μm or more, where the rigidity A represents division of a load by a displacement when the load is applied to the ring holder from one direction of the rotational axis with the fluid supplied from the other direction, and the rigidity B represents division of a load by a displacement when the load is applied to the ring holder from the direction perpendicular to the rotational axis with the fluid supplied from the opposite direction.

Such a double-disc grinding apparatus can reliably obtain more highly precise nanotopography stably.

Moreover, the present invention provides a workpiece double-disc grinding method comprising: supporting a sheet workpiece along a circumferential direction from an outer circumference side of the workpiece by a ring holder; and simultaneously grinding both surfaces of the workpiece supported by the ring holder with a pair of grinding wheels while rotating the ring holder, wherein fluid is supplied from both of a direction of a rotational axis of the ring holder and a direction perpendicular to the rotational axis at independently controlled supply pressures, and both the surfaces of the workpiece are simultaneously ground while the ring holder is supported without contact from both the directions by hydrostatic pressure of the supplied fluid with a hydrostatic bearing.

Such a method can independently control support rigidities of the ring holder in the direction of the rotational axis and the direction perpendicular to the rotational axis, enabling highly precise nanotopography to be obtained stably in every grinding process even when the workpiece lot is changed or the grinding wheels are exchanged.

In a preferable method, the supply pressures at which the fluid is supplied are controlled such that a degree of rigidity A is 200 gf/μm or less and a degree of rigidity B is 800 gf/μm or more, where the rigidity A represents division of a load by a displacement when the load is applied to the ring holder from one direction of the rotational axis with the fluid supplied from the other direction, and the rigidity B represents division of a load by a displacement when the load is applied to the ring holder from the direction perpendicular to the rotational axis with the fluid supplied from the opposite direction.

In this way, more highly precise nanotopography can reliably be obtained stably.

Advantageous Effects of Invention

In the inventive double-disc grinding apparatus, fluid is supplied from both of the direction of a rotational axis of a ring holder and the direction perpendicular to the rotational axis at independently controlled supply pressures, and both the surfaces of the workpiece are simultaneously ground while the ring holder is supported without contact from both the directions by hydrostatic pressure of the supplied fluid with a hydrostatic bearing; therefore the support rigidities of the ring holder in the direction of the rotational axis and the direction perpendicular to the rotational axis can be independently controlled and highly precise nanotopography can be obtained stably in every grinding process even when the workpiece lot is changed or the grinding wheels are exchanged.

DESCRIPTION OF EMBODIMENTS

Figure 1:
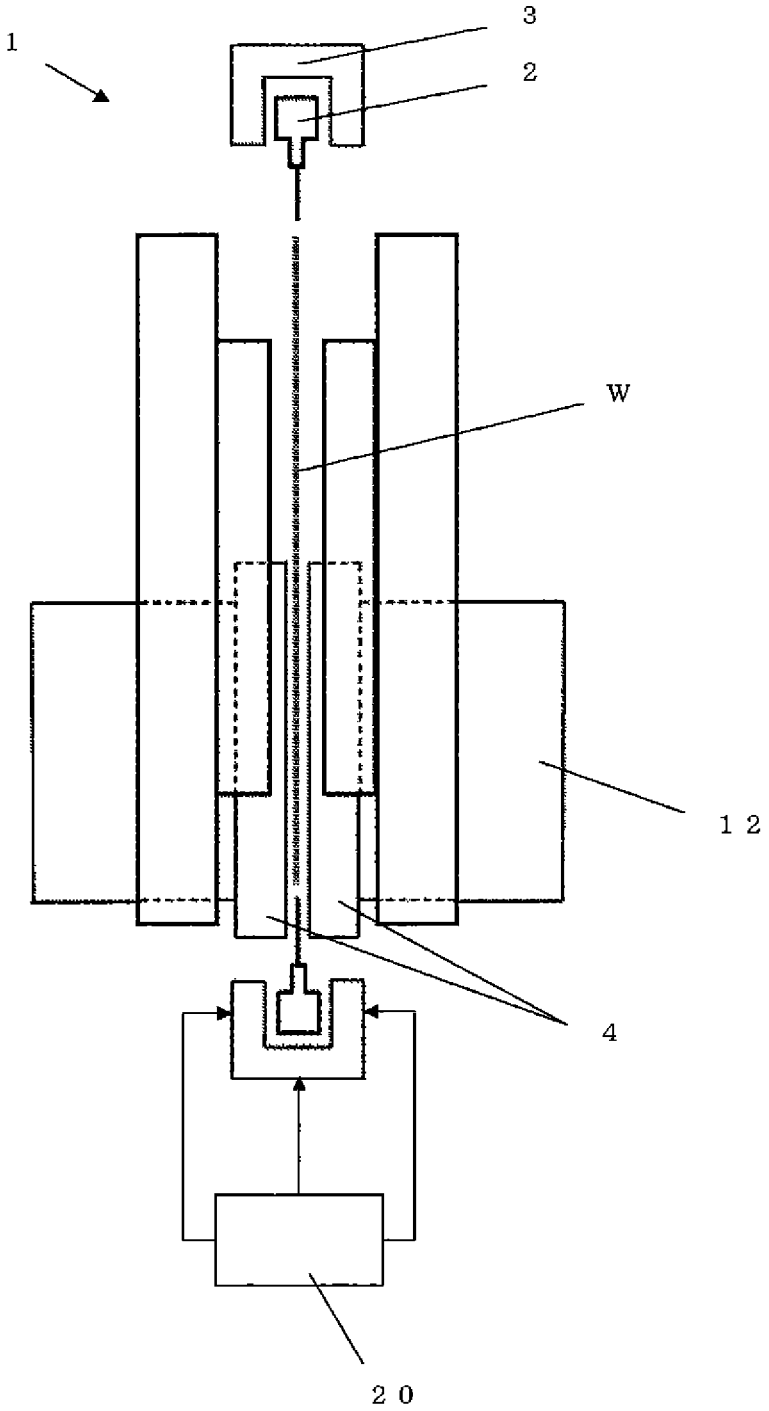
FIG. 1 is a schematic diagram of an exemplary double-disc grinding apparatus of the present invention.

Embodiments of the present invention will be described below, but the present invention is not limited to these embodiments.

As described above, the investigation by the present inventor revealed that the degradation of nanotopography is caused by the effects of raw material workpieces and grinding wheels to be used. Furthermore, the inventor diligently considered how to reduce the effects of raw material workpieces and grinding wheels to be used in a method of using a hydrostatic bearing to support a ring holder, and consequently found the following.

In conventional double-disc grinding, grinding conditions on right and left sides differ depending on variations in the shape and the front and back surface roughness of a raw material workpiece and in self-sharpening of right and left grinding wheels; the grinding is thought to proceed while the workpiece is subjected to complicated forces from both the sides. The rotating surfaces of the workpiece when the forces are balanced on both the sides accordingly slightly differ in every grinding process. It is understood that the deviation of these rotating surfaces from rotating surfaces of the ring holder produces a local difference in processing pressure, resulting in slight degradation of nanotopography.

It is considered that it is effective in preventing nanotopography degradation to eliminate the local difference in processing pressure by reducing support rigidity of the ring holder in the direction of the rotational axis to thereby increase a degree of freedom for support such that the ring holder can rotate so as to follow the rotating surfaces of the workpiece in the state where the forces are balanced on both the sides, which differ in every grinding process.

A conventional hydrostatic bearing is however configured to supply fluids from both of the direction of the rotational axis of the ring holder and the direction perpendicular to the rotational axis with one source of supply and to adjust fluid supply pressures to the same value; if the degree of freedom for support in the direction of the rotational axis of the ring holder is increased, the support rigidity in the direction perpendicular to the rotational axis is also decreased at the same time. The ring holder is therefore easy to rotate eccentrically in the direction perpendicular to the rotational axis of the ring holder, preventing stable grinding.

The present invention accordingly allows fluids to be supplied independently in the direction of the rotational axis of the ring holder and the direction perpendicular to the rotational axis, that is, has a configuration that enables fluid supply pressures to be independently controlled, thereby enabling grinding with an increased degree of freedom for support in the direction of the rotational axis while maintaining the support rigidity in the direction perpendicular to the rotational axis, so more highly precise nanotopography can consequently be obtained stably.

The inventor further fully considered the best mode for carrying out the present invention on the basis of the above consideration, thereby brought the invention to completion.

A double-disc grinding apparatus of the present invention will now be described.

As shown in FIG. 1, the inventive double-disc grinding apparatus 1 mainly has a ring holder 2 configured to hold a workpiece W, a hydrostatic bearing 3 for supporting the ring holder 2 without contact by hydrostatic pressure of fluid, and a pair of grinding wheels 4 for simultaneously grinding both surfaces of the workpiece W.

Figure 2A:
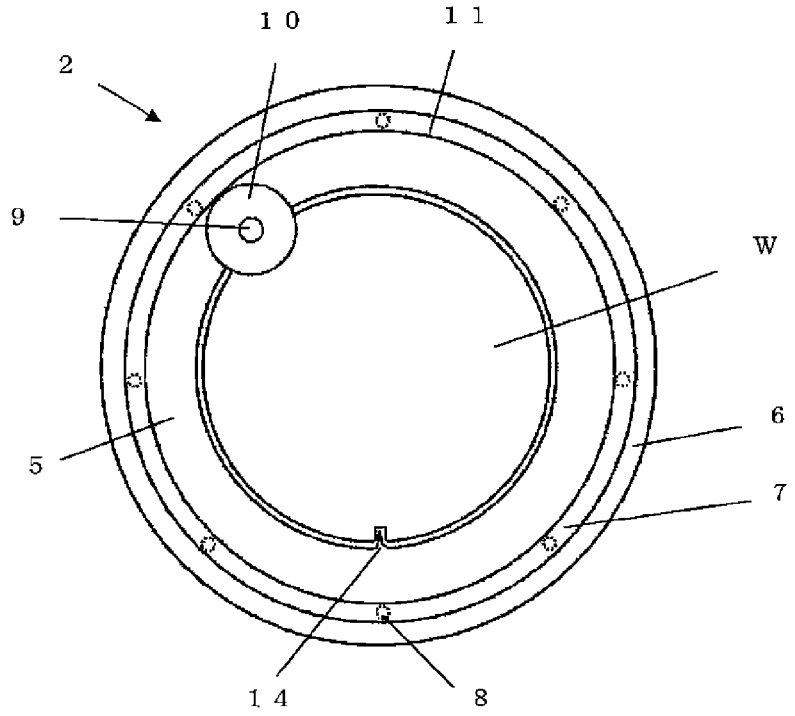
FIG. 2A is a schematic side view of an exemplary ring holder of the inventive double-disc grinding apparatus.
Figure 2B:
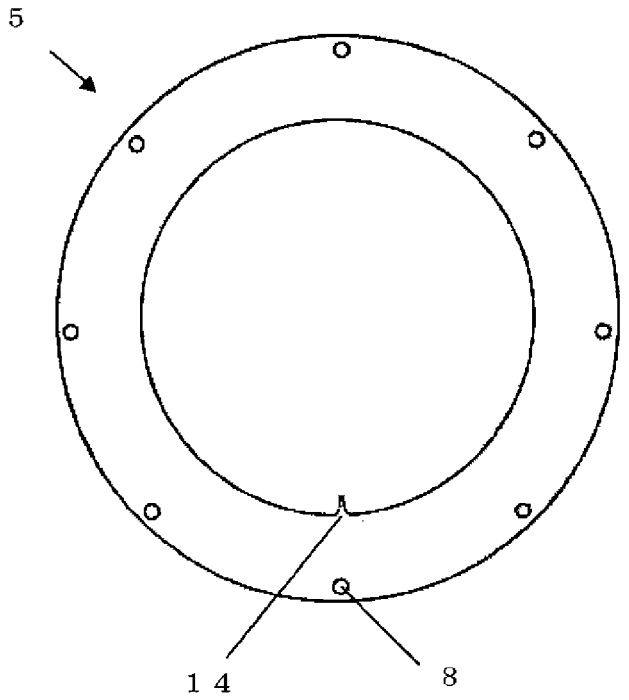
FIG. 2B is a schematic side view of a carrier of an exemplary ring holder of the inventive double-disc grinding apparatus.

The ring holder 2 supports the workpiece W along a circumferential direction of the workpiece from the outer circumference side, and can rotate about a rotational axis. As shown in FIG. 2A, the ring holder 2 includes a carrier 5 having, at the center, a holding hole configured to insert and support the workpiece W therein, a holder body 6 for attaching the carrier 5, and a ring 7 for pressing the attached carrier 5. As shown in FIGS. 2A and 2B, the carrier 5 is provided with attachment holes 8 through which the carrier is attached to the holder body 6, for example, with screws.

A driving gear 10 connecting with a holder motor 9 is disposed to rotate the ring holder 2. The driving gear 10 is engaged with an internal gear 11 so that the ring holder 2 can be rotated through the internal gear 11 by rotation of the driving gear 10 with the holder motor 9.

As shown in FIG. 2A, a protrusion 14 is formed on the edge of the holding hole of the carrier 5 so as to extend inward. This protrusion fits the shape of a groove called a notch formed on a circumferential portion of the workpiece W and enables rotational motion of the ring holder 2 to be transmitted to the workpiece W.

The ring holder 2 is supported by the hydrostatic bearing 3, so the ring holder 2 can rotate with high precision.

Figure 3:
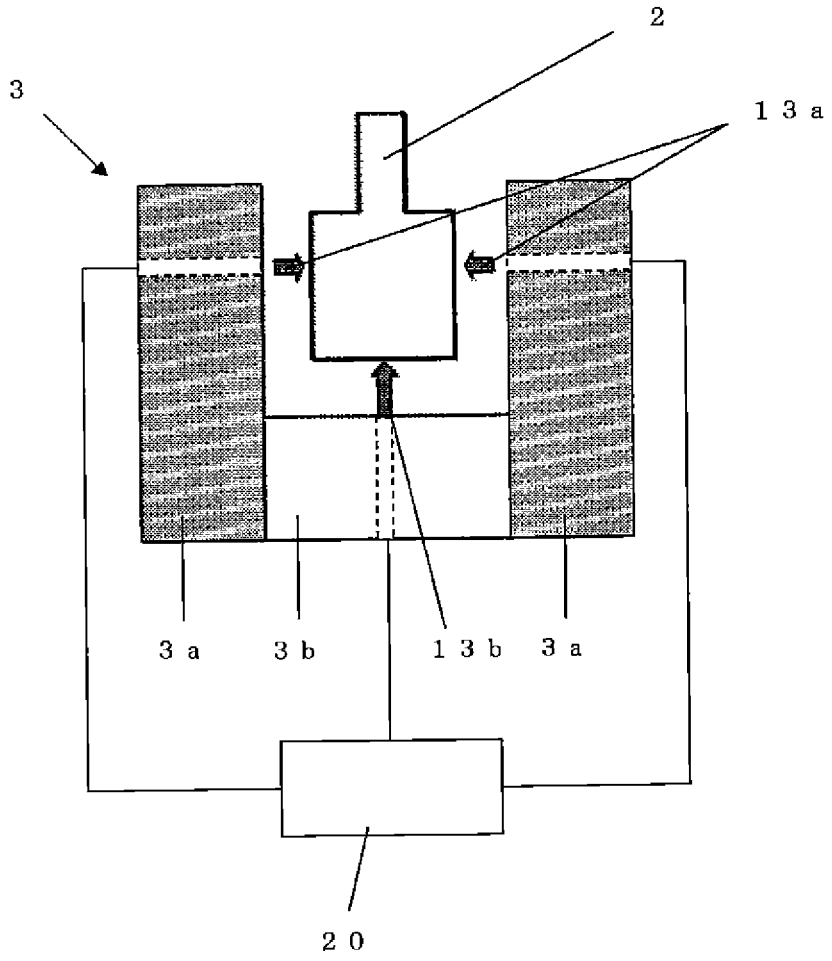
FIG. 3 is an explanatory view of a method of supporting a ring holder with a hydrostatic bearing.

The hydrostatic bearing 3 will now be described. As shown in FIG. 3, the hydrostatic bearing 3 includes a bearing member 3*a* disposed so as to face both side faces of the ring holder 2 and a bearing member 3*b* disposed so as to face the outer circumferential face of the ring holder 2. The bearing member 3*a* is provided with a supply channel through which fluid is supplied to both the side faces of the ring holder 2. The bearing member 3*b* is provided with a supply channel through which fluid is supplied to the outer circumferential face.

As shown in FIG. 3, through these supply channels, a fluid-supplying unit 20 supplies a fluid 13*a* to spaces between the side faces of the ring holder 2 and the bearing member 3*a* from the direction of the rotational axis of the ring holder 2, and a fluid 13*b* to a space between the outer circumferential face of the ring holder 2 and the bearing member 3*b* from the direction perpendicular to the rotational axis.

In this way, the ring holder 2 is supported in a non-contact state by the hydrostatic pressure of the supplied fluids from the direction of the rotational axis by the bearing member 3*a* and from the direction perpendicular to the rotational axis by the bearing member 3*b*.

The fluid-supplying unit 20 is configured to be capable of independently controlling a supply pressure at which the fluid 13*a* is supplied from the direction of the rotational axis and a supply pressure at which the fluid 13*b* is supplied from the direction perpendicular to the rotational axis. Except for this, the fluid-supplying unit 20 is not particularly limited; for example, pressure adjusting valves may be disposed on supply routes of the fluids to adjust each of the supply pressures or two completely separate fluid-supplying units may be provided. The fluid supplied to the hydrostatic bearing 3 may be, but not particularly limited to, water or air, for example.

As shown in FIG. 1, the grinding wheels 4 are connected with grinding-wheel motors 12 and can rotate at a high speed. The grinding wheel 4 is not particularly limited and may be the same as a conventional grinding wheel. For example, a grinding wheel having an abrasive-grain size of #3000 and an average abrasive-grain diameter of 4 μm may be used. A grinding wheel having a smaller abrasive-grain size of #6000 to #8000 may also be used; examples of this type include a grinding wheel including diamond abrasive grains with an average abrasive-grain diameter of 1 μm or less and a vitrified bond material.

The double-disc grinding apparatus 1 can independently control the rigidities of the ring holder 2 in the direction of the rotational axis and in the direction perpendicular to the rotational axis by independently controlling the supply pressures at which the fluids are supplied to the hydrostatic bearing 3. The apparatus can thereby reduce the supply pressure at which the fluid is supplied from the direction of the rotational axis of the ring holder 2 to thereby reduce the rigidity of the ring holder 2 in this direction, that is, the apparatus can increase the degree of freedom for support, while increasing the supply pressure at which the fluid is supplied from the direction perpendicular to the rotational axis of the ring holder 2 to maintain sufficiently high rigidity of the ring holder 2 in this direction. The apparatus can support the ring holder 2 under these conditions. Supporting the ring holder 2 in this way enables inhibition of local pressure differential during grinding, thereby enabling highly precise nanotopography to be obtained stably in every grinding process, even when the lot of a workpiece is changed or the grinding wheels are exchanged.

Regarding the definition of the above-described rigidity in this embodiment, rigidity 'A' in the direction of a rotational axis is defined as division of a load by a displacement (gf/μm) when the load is applied to the ring holder 2 from one direction of the rotational axis with a fluid supplied from the other direction, and the displacement of the ring holder 2 is measured; rigidity 'B' in the direction perpendicular to the rotational axis is defined as division of a load by a displacement (gf/μm) when the load is applied to the ring holder 2 from the direction perpendicular to the rotational axis with a fluid supplied from the opposite direction, and the displacement of the ring holder 2 is measured.

The fluid-supplying unit 20 is preferably capable of controlling the fluid supply pressures such that the degree of rigidity A is 200 gf/μm or less and the degree of rigidity B is 800 gf/μm or more.

The apparatus of this type can more reliably inhibit the above local pressure differential, enabling more highly precise nanotopography to be reliably obtained stably.

If a special unit for increasing pressure is not used, a water supply pressure is usually about 0.30 MPa. In this case, the maximum rigidity is about 1500 gf/μm. The hydrostatic bearing needs to have a rigidity of 50 gf/μm or more to perform its function, depending on the weight of the ring holder.

The inventive workpiece double-disc grinding method will be next described. This embodiment describes the case of using the inventive double-disc grinding apparatus 1 shown in FIGS. 1 to 3.

First, a sheet workpiece W, such as a silicon wafer, is supported along a circumferential direction from the outer circumference side of the workpiece with the ring holder 2. The hydrostatic bearing 3 to support the ring holder 2 is disposed such that the bearing member 3*a* faces both side faces of the ring holder 2 and the bearing member 3*b* faces the outer circumferential face of the ring holder 2 as above.

Next, from the fluid-supplying unit 20 through the supply channels of the hydrostatic bearing 3, a fluid is supplied to the spaces between the side faces of the ring holder 2 and the bearing member 3*a* from the direction of the rotational axis of the ring holder 2; a fluid is supplied to the space between the outer circumferential face of the ring holder 2 and the bearing member 3*b* from the direction perpendicular to the rotational axis. The ring holder 2 is supported in a non-contact state by the hydrostatic pressure of the supplied fluids from the direction of the rotational axis by the bearing member 3*a* and from the direction perpendicular to the rotational axis by the bearing member 3*b*.

In this way, the ring holder 2 is supported with the hydrostatic bearing 3 from both of the direction of the rotational axis of the ring holder 2 and the direction perpendicular to the rotational axis, and both surfaces of the workpiece W is then simultaneously ground while the ring holder 2 is rotated with the holder motor 9 and the grinding wheels 4 are rotated with the grinding wheel motors 12.

As in the above description of the inventive double-disc grinding apparatus, the inventive workpiece double-disc grinding method can control independently the rigidities of the ring holder in the direction of the rotational axis and in the direction perpendicular to the rotational axis to thereby increase the degree of freedom for support in the direction of the rotational axis of the ring holder 2 while the rigidity in the direction perpendicular to the rotational axis of the ring holder 2 is maintained at a sufficiently high level so that local pressure differential is inhibited during grinding. Consequently, highly precise nanotopography can be obtained stably in every grinding process, even when the lot of a workpiece is changed or the grinding wheels are exchanged.

At that time, the rigidity of the ring holder can be readily controlled by adjusting the supply pressures at which the fluids are supplied. More specifically, increasing the supply pressure can vary the rigidity to be higher and decreasing the supply pressure can vary the rigidity to be lower. A preferable fluid supply pressure is, for example, a pressure at which the rigidity A in the direction of the rotational axis becomes 200 gf/μm or less and the rigidity B in the direction perpendicular to the rotational axis becomes 800 gf/μm or more.

In this manner, more highly precise nanotopography can be reliably obtained stably.

EXAMPLE

The present invention will be more specifically described below with reference to examples and comparative example, but the present invention is not limited to these examples.

Examples 1 to 4

A 300-mm-diameter silicon wafer was ground with the inventive double-disc grinding apparatus 1 shown in FIG. 1. Grinding wheels made of a vitrified bond material, SD#3000 (vitrified grinding wheels made by A.L.M.T. Corp.), were used. The amount of grinding was 40 μm. Water was used as the fluids used to support the ring holder.

The supply pressures at which the fluids were supplied in the direction of the rotational axis of the ring holder and the direction perpendicular to the rotational axis were adjusted in the following manner.

Figure 4:
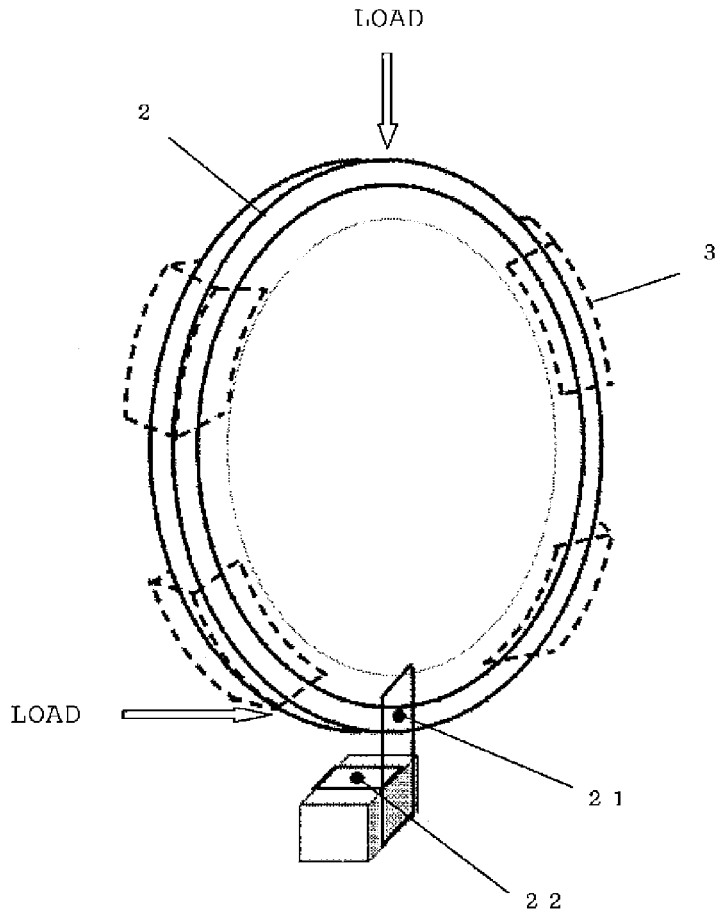
FIG. 4 is an explanatory view of a method of adjusting a supply pressure at which fluid is supplied.
Figure 5:
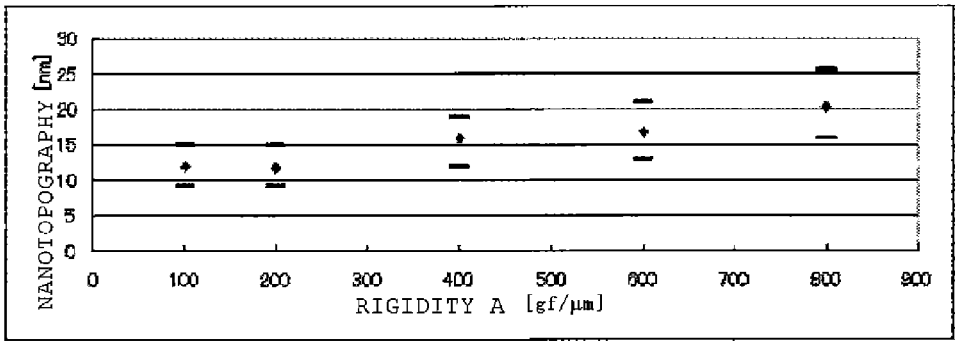
FIG. 5 is a graph showing the result of example 1.
Figure 6:
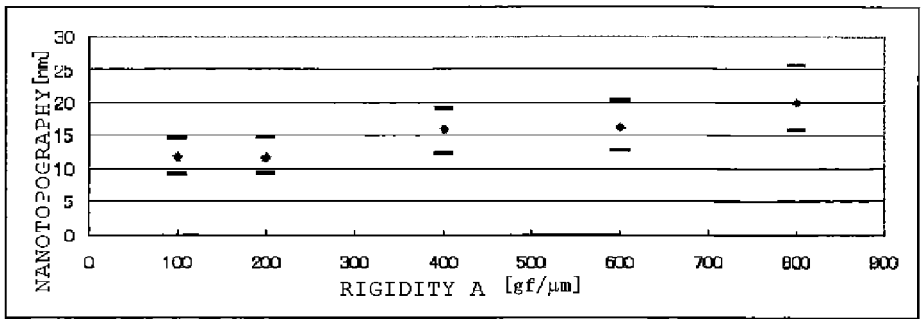
FIG. 6 is a graph showing the result of example 2.
Figure 7:
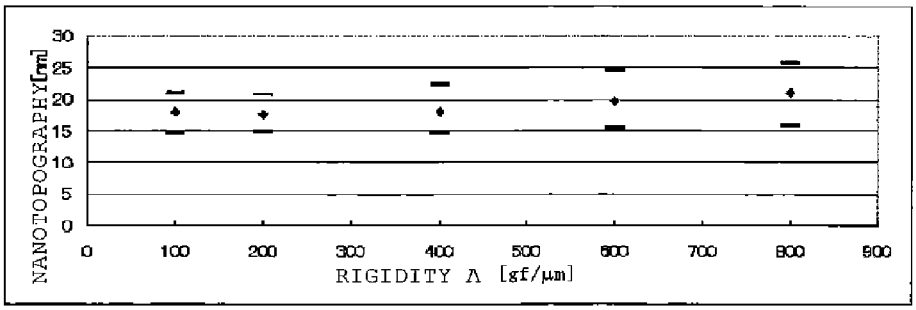
FIG. 7 is a graph showing the result of example 3.
Figure 8:
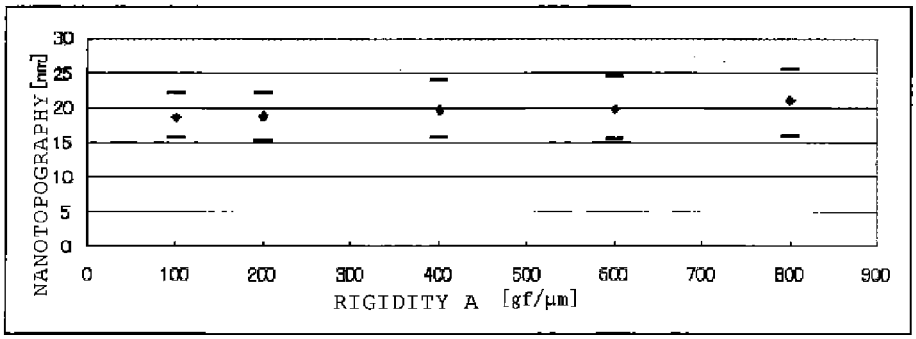
FIG. 8 is a graph showing the result of example 4.

As shown in FIG. 4, eddy current sensors 21 and 22 were installed to measure the displacement of the ring holder. A load of 10 to 30 N was applied from opposite side of each of the sensors with force gages. Each supply pressure at which water was supplied to the hydrostatic bearing was adjusted such that the rigidity A and the rigidity B, calculated by the expression Load/Displacement (gf/μm), became desired values.

The rigidity B was 1200 gf/μm in example 1, 800 gf/μm in example 2, 600 gf/μm in example 3, and 400 gf/μm in example 4; the rigidity A was changed to evaluate nanotopography when the silicon wafer was subjected to double-disc grinding.

Comparative Example

A silicon wafer was ground under the same conditions as in example 1 except that a conventional double-disc grinding apparatus, which is not capable of controlling independently fluids supplied from both of the direction of the rotational axis of a ring holder and the direction perpendicular to the rotational axis, was used and the supply pressures at which the fluids were supplied from both the directions were identical. As in example 1, nanotopography when the supply pressures were changed was evaluated.

Result of Examples 1 to 4 and Comparative Example

Figure 9:
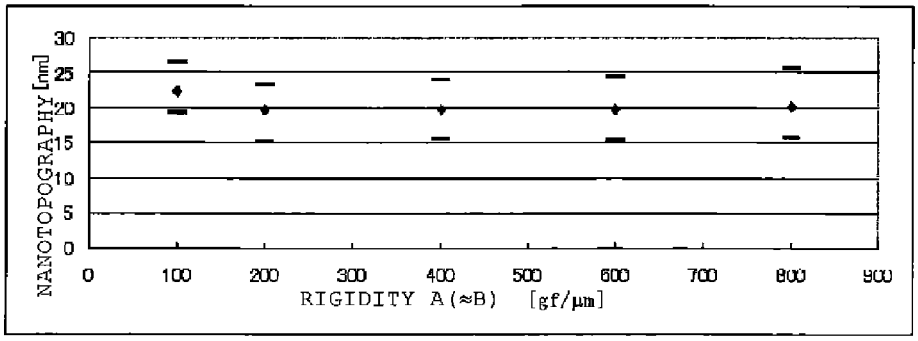
FIG. 9 is a graph showing the result of comparative example.
Figure 10:
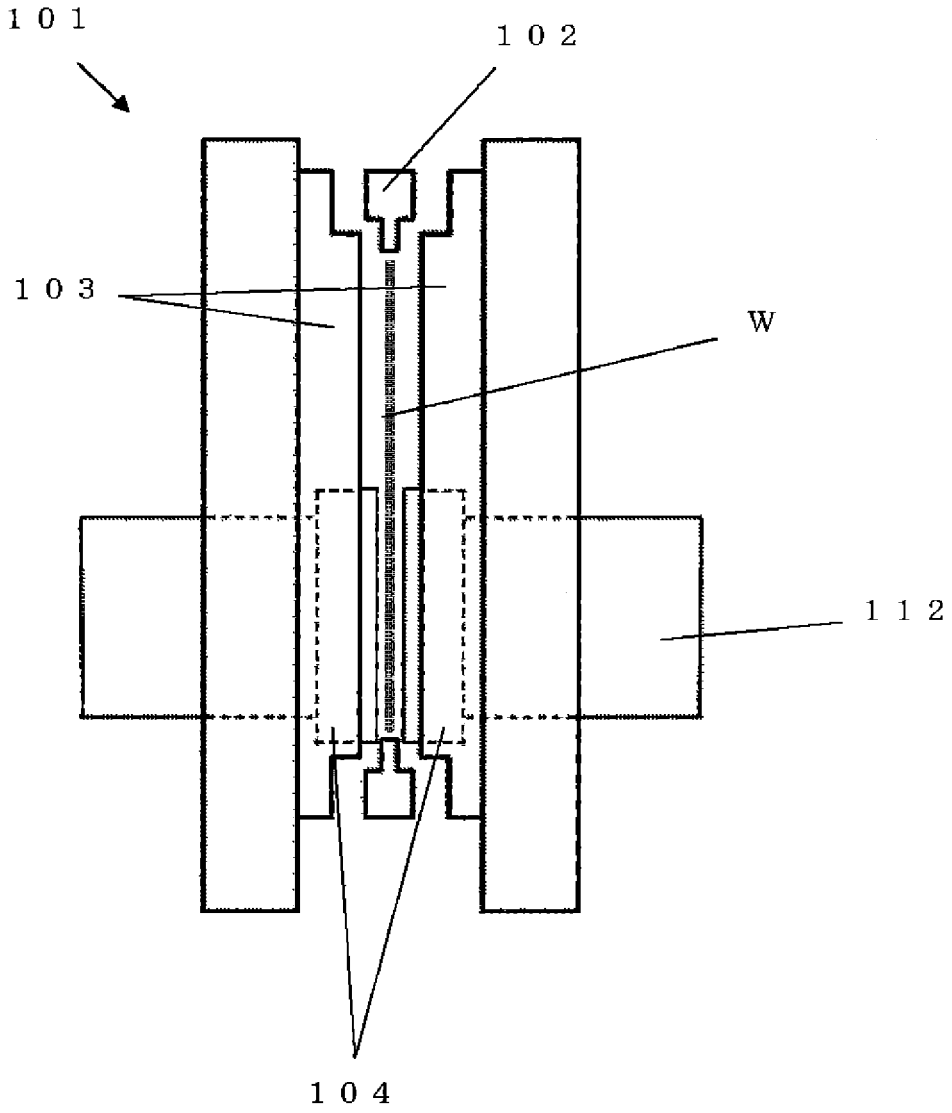
FIG. 10 is a schematic diagram of an example of a conventional double-disc grinding apparatus.

FIGS. 5 to 8 show the results of examples 1 to 4, respectively. FIG. 9 shows the result of comparative example.

As shown in FIGS. 5 to 8, all examples 1 to 4 demonstrated that when the rigidity A is smaller than the rigidity B, nanotopography is improved. As shown particularly in FIGS. 5 and 6, it is understood that when the rigidity B was 800 gf/μm or more and the rigidity A was 200 gf/μm or less, nanotopography was significantly improved as compared with the result of comparative example. Regarding this tendency, there was no clear difference between example 1 and example 2; both examples exhibited equivalent effect on improvement.

In addition, in examples 1 to 4, nanotopography was not degraded even when the workpiece lot was changed and the grinding wheels were exchanged.

In contrast, as shown in FIG. 9, comparative example did not exhibit the improvement in nanotopography even when the rigidities A and B were changed; when the rigidities were 200 gf/μm or less, indeed, the nanotopography had a tendency to degrade.

It was accordingly confirmed that the inventive double-disc grinding apparatus and workpiece double-disc grinding method enables variation in nanotopography, which occurs depending on a workpiece lot or grinding wheels, to be improved, thereby obtaining highly precise nanotopography stably in every grinding process. It is found that fluid supply pressures that particularly maintain a rigidity A of 200 gf/μm or less and a rigidity B of 800 gf/μm or more are preferable conditions of the present invention.

It is to be noted that the present invention is not limited to the foregoing embodiment. The embodiment is just an exemplification, and any examples that have substantially the same feature and demonstrate the same functions and effects as those in the technical concept described in claims of the present invention are included in the technical scope of the present invention.

The invention claimed is:

1. A double-disc grinding apparatus comprising:

a rotatable ring holder configured to support a sheet workpiece along a circumferential direction from an outer circumference side of the workpiece;

a pair of grinding wheels configured to simultaneously grind two surfaces of the workpiece supported by the ring holder; and a hydrostatic bearing configured to support the ring holder without contact from both of a direction of a rotational axis of the ring holder and a direction perpendicular to the rotational axis by hydrostatic pressure of fluid supplied from both the directions, wherein supply pressures at which the fluid is supplied from the direction of the rotational axis and from the direction perpendicular to the rotational axis are independently controlled, and the supply pressures at which the fluid is supplied are controlled such that a degree of rigidity A is 200 gf/μm or less and a degree of rigidity B is 800 gf/μm or more, where the rigidity A represents division of a load by a displacement when the load is applied to the ring holder from one direction of the rotational axis with the fluid supplied from an other direction, and the rigidity B represents division of a load by a displacement when the load is applied to the ring holder from a direction perpendicular to the rotational axis with the fluid supplied from an opposite direction.

2. A workpiece double-disc grinding method comprising:

supporting a sheet workpiece along a circumferential direction from an outer circumference side of the workpiece by a ring holder;

simultaneously grinding two surfaces of the workpiece supported by the ring holder with a pair of grinding wheels while rotating the ring holder, wherein fluid is supplied from both of a direction of a rotational axis of the ring holder and a direction perpendicular to the rotational axis at independently controlled supply pressures, and both the surfaces of the workpiece are simultaneously ground while the ring holder is supported without contact from both the directions by hydrostatic pressure of the supplied fluid with a hydrostatic bearing, and the supply pressures at which the fluid is supplied are controlled such that a degree of rigidity A is 200 gf/μm or less and a degree of rigidity B is 800 gf/μm or more, where the rigidity A represents division of a load by a displacement when the load is applied to the ring holder from one direction of the rotational axis with the fluid supplied from an other direction, and the rigidity B represents division of a load by a displacement when the load is applied to the ring holder from the direction perpendicular to the rotational axis with the fluid supplied from an opposite direction.

* * * * *